US010227849B2

(12) United States Patent
Huh et al.

(10) Patent No.: US 10,227,849 B2
(45) Date of Patent: Mar. 12, 2019

(54) SYSTEM AND METHODOLOGY FOR FACILITATING GRAVEL PACKING OPERATIONS

(71) Applicant: Schlumberger Technology Corporation, Sugar Land, TX (US)

(72) Inventors: Michael Huh, Pearland, TX (US); Andrew Dorban, Houston, TX (US); Seth Alan Conaway, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 176 days.

(21) Appl. No.: 15/167,736

(22) Filed: May 27, 2016

(65) Prior Publication Data

US 2017/0342809 A1 Nov. 30, 2017

(51) Int. Cl.

| | |
|---|---|
| ***E21B 43/04*** | (2006.01) |
| ***E21B 43/08*** | (2006.01) |
| ***E21B 34/06*** | (2006.01) |
| *E21B 34/00* | (2006.01) |

(52) U.S. Cl.

CPC ..... *E21B 43/04* (2013.01); *E21B 34/06* (2013.01); *E21B 43/08* (2013.01); *E21B 2034/007* (2013.01)

(58) Field of Classification Search

CPC ..... E21B 43/04; E21B 43/08; E21B 43/082; E21B 43/086; E21B 43/088; E21B 34/06; E21B 2034/007

See application file for complete search history.

(56) References Cited

U.S. PATENT DOCUMENTS

| | | | | |
|---|---|---|---|---|
| 5,341,880 A * | 8/1994 | Thorstensen | B01D 29/15 | 166/278 |
| 2003/0029614 A1* | 2/2003 | Michel | E21B 43/04 | 166/278 |
| 2008/0142227 A1* | 6/2008 | Yeh | E21B 17/02 | 166/369 |
| 2010/0051262 A1* | 3/2010 | Dusterhoft | E21B 43/08 | 166/236 |

* cited by examiner

*Primary Examiner* — Brad Harcourt

(57) ABSTRACT

A technique facilitates formation of a gravel pack in a wellbore. Gravel slurry is delivered downhole to a desired gravel packing zone located along an annulus surrounding a gravel packing completion. Dehydration of the gravel pack is facilitated by providing a return flow path for a carrier fluid along drainage layers of adjacent screen assemblies. The drainage layers of adjacent screen assemblies are coupled by drainage layer shunt tubes which bypass corresponding couplings between the adjacent screen assemblies. In some applications, the drainage layer shunt tubes facilitate delivery of the returning carrier fluid to a sliding sleeve assembly.

18 Claims, 4 Drawing Sheets

SYSTEM AND METHODOLOGY FOR FACILITATING GRAVEL PACKING OPERATIONS

BACKGROUND

Gravel packs are used in wells for removing particulates from inflowing hydrocarbon fluids. In a variety of applications gravel packing is performed in long horizontal wells by pumping slurry comprising gravel suspended in a carrier fluid down the annulus between the wellbore wall and screen assemblies. The slurry is then dehydrated by returning the carrier fluid to the surface after depositing the gravel in the wellbore annulus. To return to the surface, the carrier fluid flows inwardly through the screen assemblies and into a production tubing which routes the returning carrier fluid back to the surface. In some applications, inflow control devices have been combined with the screen assemblies to provide control over the inflow of production fluids.

Sometimes the inflow control devices may be combined with alternate path type screen assemblies which utilize shunt tubes for transporting slurry. For example, the slurry may be moved through shunt tubes once bridging has occurred in the annulus surrounding the screen assemblies. The slurry flows through the shunt tubes and exits through nozzles to enable bypassing of the bridging and to enhance gravel packing of the annulus. When inflow control devices are utilized, however, the complexity of the dehydration process is increased because return flow of the carrier fluid through the inflow control devices may be insufficient to obtain reasonable pumping times for gravel packing an entire production zone.

SUMMARY

In general, a system and methodology are provided for facilitating formation of a gravel pack in a wellbore. Gravel slurry is delivered downhole to a desired gravel packing zone located along an annulus surrounding a gravel packing completion. Dehydration of the gravel pack is facilitated by providing a return flow path for a carrier fluid along drainage layers of adjacent screen assemblies. The drainage layers of adjacent screen assemblies are coupled by drainage layer shunt tubes which bypass corresponding couplings between the adjacent screen assemblies. In some embodiments, the drainage layer shunt tubes facilitate delivery of the returning carrier fluid to a sliding sleeve assembly.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
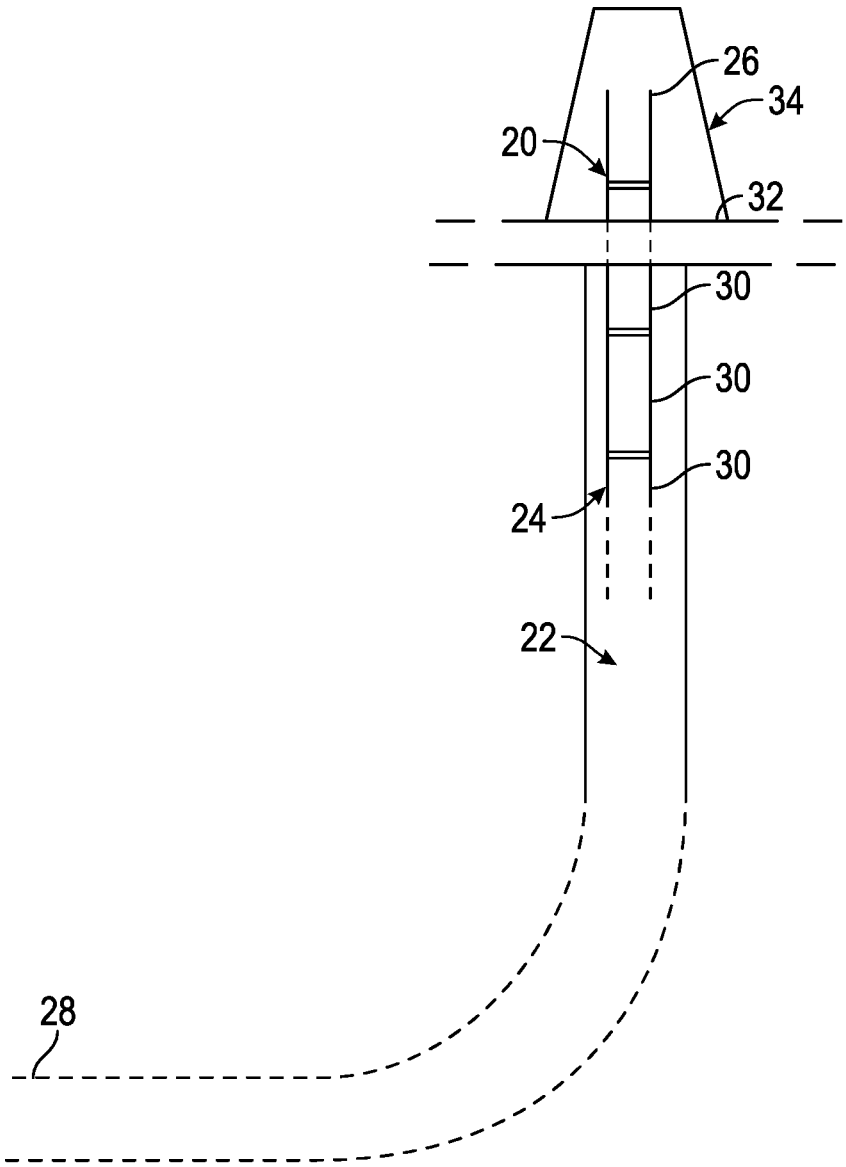
FIG. 1 is a schematic illustration of an example of a gravel packing system deployed downhole into a wellbore from a rig, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate formation of gravel packs in wellbores. A gravel packing system is constructed so that gravel slurry is delivered downhole to form a gravel pack in a wellbore. The gravel slurry is delivered to a desired gravel packing zone located along an annulus surrounding a gravel packing completion. Once placed in the desired gravel packing zone, the gravel pack is dehydrated through removal of a carrier fluid from the gravel used to form the gravel slurry.

Dehydration of the gravel pack is facilitated by providing a return flow path for the carrier fluid which improves the flow rate of the carrier fluid flowing from the gravel pack region to an interior of the gravel packing completion for return to the surface. As described in greater detail below, the return flow path allows the carrier fluid to flow along drainage layers of adjacent screen assemblies. The drainage layers of the adjacent screen assemblies are coupled by drainage layer shunt tubes which bypass corresponding couplings between the adjacent screen assemblies. The drainage layer shunt tubes improve the flow rate of returning carrier fluid, particularly in embodiments utilizing screen assemblies with solid base pipes combined with a flow control devices. In some embodiments, the drainage layer shunt tubes facilitate delivery of the returning carrier fluid to a sliding sleeve assembly.

The drainage layer shunt tubes and overall improved drainage system may be constructed in various embodiments for use in several different applications in which it is useful to connect drainage layers of sequential sections of a gravel packing completion. For example, one or more drainage layer shunt tubes may be employed between sequential sections of gravel packing multistage completions and/or in gravel packing completions using alternate path screen assembly sections having inflow control devices. The drainage layer shunt tubes may be used to couple sequential drainage layers without the use of specialized couplings between base pipes.

According to an embodiment, a drainage layer shunt tube is used to transport returning carrier fluid from a drainage layer of one screen assembly section to the drainage layer of another screen assembly section (and/or to another completion section). The returning carrier fluid is the fluid flowing from the gravel slurry as the gravel pack is dehydrated. The returning carrier fluid passes inwardly through filter screens of the screen assembly sections. The drainage layer shunt tube may be in the form of a single tube or a plurality of tubes extending between adjacent drainage layers. Use of drainage layer shunt tubes to connect adjacent drainage layers improves the rate of flow with respect to the returning carrier fluid and also provides for reduced complexity on the rig floor. Drainage layer shunt tubes are easily connected and provide an economical and time efficient methodology for connecting drainage layers, e.g. sequential drainage layers along a gravel packing completion.

In alternate path applications, shunt tubes and packing tubes are used for transporting and delivering gravel slurry to a desired well zones even when bridging occurs along the annulus. Some alternate path applications utilize screen assemblies with solid walled base pipes combined with inflow control devices. When using inflow control devices alone for return flow of carrier fluid, the flow rate of the returning carrier fluid may be undesirably low. The drainage layer shunt tubes, however, may be connected to the drainage layers of adjoining screen assemblies to improve the flow rate. In some embodiments, a drainage layer shunt tube also may be connected to an opening/port in a sliding sleeve assembly to facilitate rapid flow of the returning carrier fluid into an interior of the gravel packing completion for return to a surface collection location.

Referring generally to FIG. 1, an example of a well system 20 deployed in a wellbore 22 is illustrated. In this example, well system 20 comprises a gravel packing completion 24 deployed downhole into wellbore 22 on a tubing string 26. The gravel packing completion 24 is deployed to a desired gravel packing zone 28 to facilitate formation of a gravel pack. By way of example, the gravel packing completion 24 may be a multistage completion and/or an alternate path completion. In the embodiment illustrated, the gravel packing completion 24 comprises a plurality of screen assembly sections 30, i.e. screen assemblies, coupled together sequentially on a rig floor 32 and deployed downhole into wellbore 22 to the gravel packing zone 28. The deployment of tubing string 26 downhole may be facilitated via a rig 34.

Figure 2:
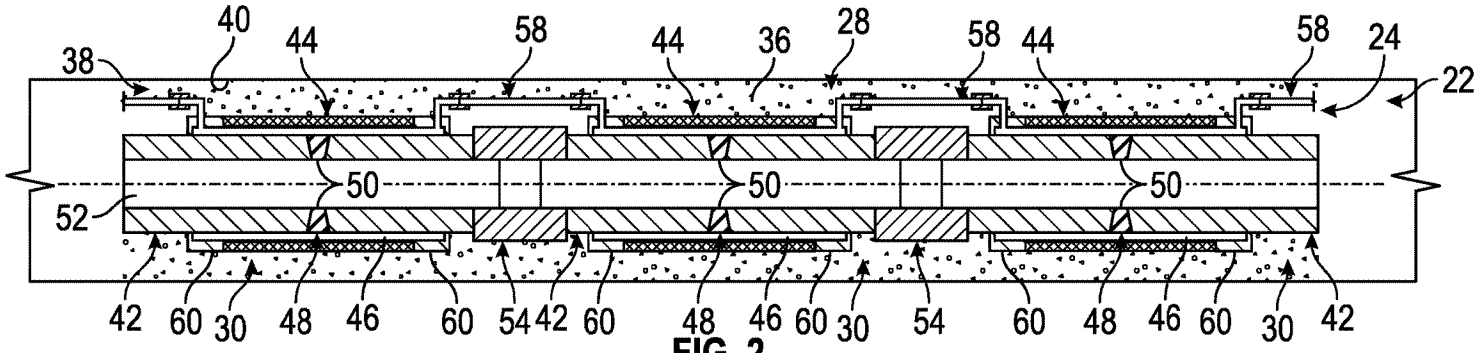
FIG. 2 is a schematic illustration of an example of a gravel packing completion comprising a plurality of screen assemblies combined with drainage layer shunt tubes connecting screen assembly drainage layers, according to an embodiment of the disclosure.

Referring generally to FIG. 2, a portion of an embodiment of gravel packing completion 24 is illustrated. In this embodiment, sequential screen assembly sections 30 of a desired number of screen assembly sections 30 are coupled together and disposed at gravel packing zone 28 to enable formation of a gravel pack 36. The gravel pack 36 may be formed in an annulus 38 generally between a surrounding wellbore wall 40 and the gravel packing completion 24.

In the embodiment illustrated in FIG. 2, each screen assembly section 30 comprises a base pipe 42 within a filter screen 44 disposed at least partially about an exterior of the corresponding base pipe 42. In a variety of applications, the filter screen 44 may be cylindrical in shape and may encircle the entire corresponding base pipe 42. As illustrated, each filter screen 44 is positioned with respect to its corresponding base pipe 42 to create a drainage layer 46 located therebetween. In some applications, each base pipe 42 may be a solid walled base pipe combined with an inflow control device 48. Each inflow control device 48 comprises at least one flow port 50, e.g. nozzle, through which fluid may flow from an exterior of the base pipe 42 to an interior 52. The interior 52 provides a flow passage extending through each base pipe 42 and through the interior of the overall gravel packing completion 24.

Adjacent screen assembly sections 30 are joined by couplings 54. For example, each coupling 54 may be used to connect sequential, adjacent base pipes 42. Additionally, a drainage layer shunt tube system 56 may be used to connect drainage layers 46 of at least some of the adjacent screen assembly sections 30. By way of example, the drainage layer shunt tube system 56 may comprise drainage layer shunt tubes 58 with at least one tube 58 coupled between selected pairs of adjacent screen assembly sections 30. Each shunt tube 58 may be arranged to extend from a drainage layer 46 of one screen assembly section 30 to the drainage layer 46 of the next adjacent screen assembly section 30 independently of coupling 54. In some embodiments, the shunt tube 58 is disposed externally of the corresponding coupling 54 and extends past the corresponding coupling 54 at a position radially outward of the coupling 54. One or more shunt tubes 58 may be used to bypass each corresponding coupling 54 between adjacent screen assembly sections 30, as illustrated.

Figure 3:
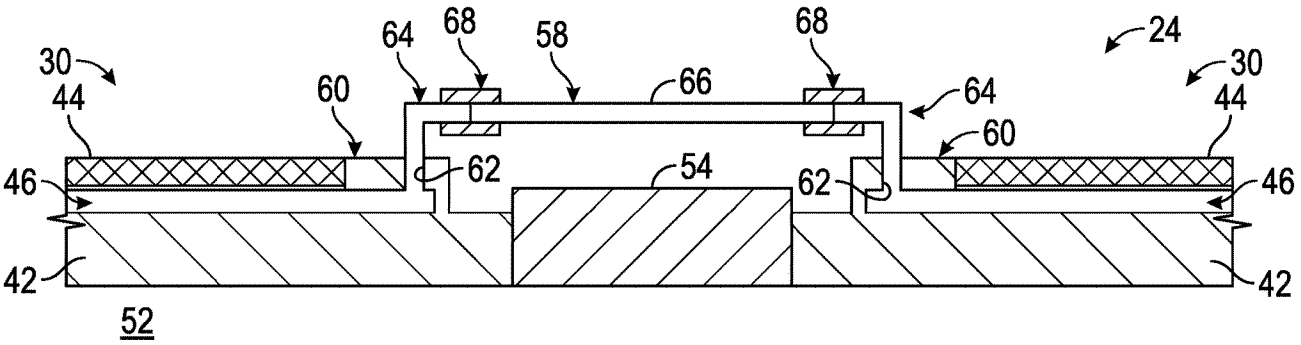
FIG. 3 is an enlarged cross-sectional view of an example of a drainage layer shunt tube system bypassing a screen assembly coupling, according to an embodiment of the disclosure.

With additional reference to FIG. 3, a specific embodiment of drainage layer shunt tube 58 is illustrated. In this example, the drainage layer shunt tube 58 is routed along a path radially outward of the corresponding coupling 54, e.g. spaced from coupling 54, to provide a flow path between drainage layers 46 independently of the coupling 54 connecting adjacent screen assembly sections 30. In this example, the filter screen 44 of each screen assembly section 30 is coupled to the corresponding base pipe 42 via end rings 60 (see also FIG. 2). The end rings 60 may be coupled with the corresponding base pipe 42 via a variety of fastening techniques, including welding, separate fasteners, threaded engagement, or other suitable devices.

In this example, each drainage layer shunt tube 58 is connected between sequential drainage layers 46 via engagement with end rings 60 of adjacent screen assembly sections 30, as illustrated in FIG. 3. By way of example, each end ring 60 may comprise a port 62 to which an and of the drainage layer shunt tube 58 is communicatively coupled for fluid flow. The drainage layer shunt tube 58 may comprise a pair of elbow sections 64 coupled to corresponding end rings 60 at ports 62 via suitable fasteners, such as clamping fasteners, threaded engagement, welding, or other suitable devices. The elbow sections 64 are coupled with a straight shunt tube section 66 via shunt tube connectors 68. By way of example, the shunt tube connectors 68 may be in the form of cylindrical connectors having suitable seals, e.g. O-ring seals, for receiving the corresponding ends of straight section 66 and elbow sections 64.

The shunt tube system 56 and the individual shunt tubes 58 provide a useful, inexpensive structure for connecting drainage layers 46 to enable flow communication of, for example, returning carrier fluid to enhance dehydration of the gravel pack. The drainage layer shunt tube (or tubes) 58 extending between each pair of adjacent screen assembly sections 30 provide a system which is readily assembled while on rig floor 32 and as the gravel packing completion 24 is assembled and deployed downhole into wellbore 22.

Figure 4:
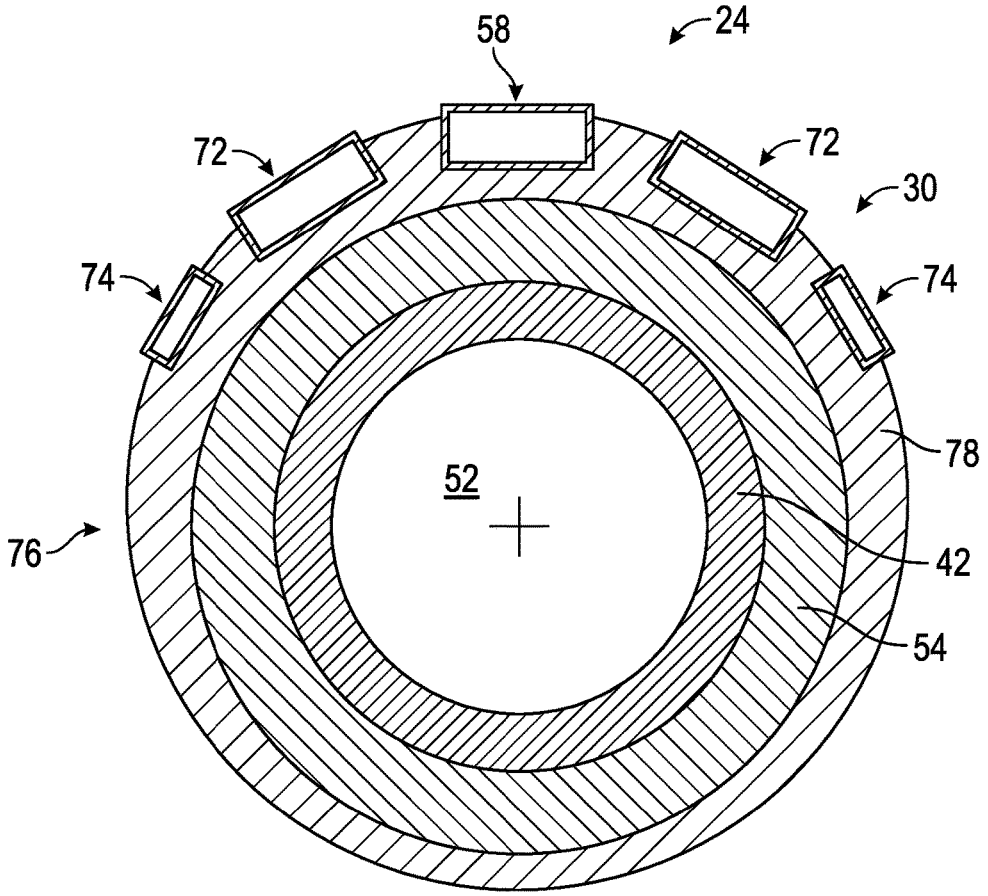
FIG. 4 is a cross-sectional view of an example of a screen assembly utilizing slurry shunt tubes and packing tubes in combination with a drainage layer shunt tube, according to an embodiment of the disclosure.

The drainage layer shunt tubes 58 are particularly useful in gravel packing completions 24 which utilize alternate path technology. The drainage layer shunt tubes 58 are readily combined with alternate path type screen assembly sections 30. In FIGS. 2 and 3, the alternate path tubes, e.g. packing tubes and slurry shunt tubes for bypassing bridging, are not shown so the dehydration layer shunt tubes 58 can be more easily illustrated and explained. However, FIG. 4 illustrates an alternate path type system combined with the drainage layer shunt tube system 56.

Referring again to FIG. 4, a cross-sectional view of one of the screen assembly sections 30 is illustrated. In this embodiment, the gravel packing completion 24 and the individual screen assembly sections 30 comprise an alternate path system 70. The alternate path system 70 facilitates delivery of slurry past bridging and to desired regions in gravel packing zone 28 so as to ensure a thorough and complete gravel pack 36. Although the alternate path system 70 may utilize a variety of tubes in various arrangements, an embodiment utilizes a plurality of slurry shunt tubes 72 for delivering slurry along the screen assembly sections 30 and a plurality of packing tubes 74 for delivering slurry to desired regions in gravel packing zone 28.

The slurry shunt tubes 72 and packing tubes 74 may be mounted to the screen assembly sections 30 via a variety of mounting structures 76. One embodiment of such a mounting structure 76 is a plurality of shunt rings 78 mounted along the exterior of the gravel packing completion 24. By way of example, the shunt rings 78 may be mounted around filter screens 44, end rings 60, couplings 54, and/or at other suitable locations along the gravel packing completion 24 to provide support for the slurry shunt tubes 72 and packing tubes 74.

Depending on the application and environment, the various features of drainage layer shunt tube system 56 and overall gravel packing completion 24 may be changed or modified. For example, the drainage layer shunt tubes 58 may be slotted or otherwise perforated to keep out sand while facilitating dehydration of the gravel pack 36 in regions where there are no filter screens 44. The drainage layer shunt tubes 58 also may incorporate other types of filters to facilitate dehydration in regions between filter screens 44 while also providing a flow path into tubes 58 between sequential drainage layers 46.

Additionally, the size and shape of the drainage layer shunt tubes 58 may be selected according to the parameters of a given operation. For example, the drainage layer shunt tubes 58 may have cross-sections which are round, square, rectangular, or another suitable shape. Additionally, the flow area as well as the wall thickness may be selected according to the parameters of a specific application or applications. The shape of elbow sections 64 also may vary. For example, the elbow sections 64 may be formed with 90° angles, 45° angles, or with other suitable angles to appropriately position straight tube section 66.

Figure 5:
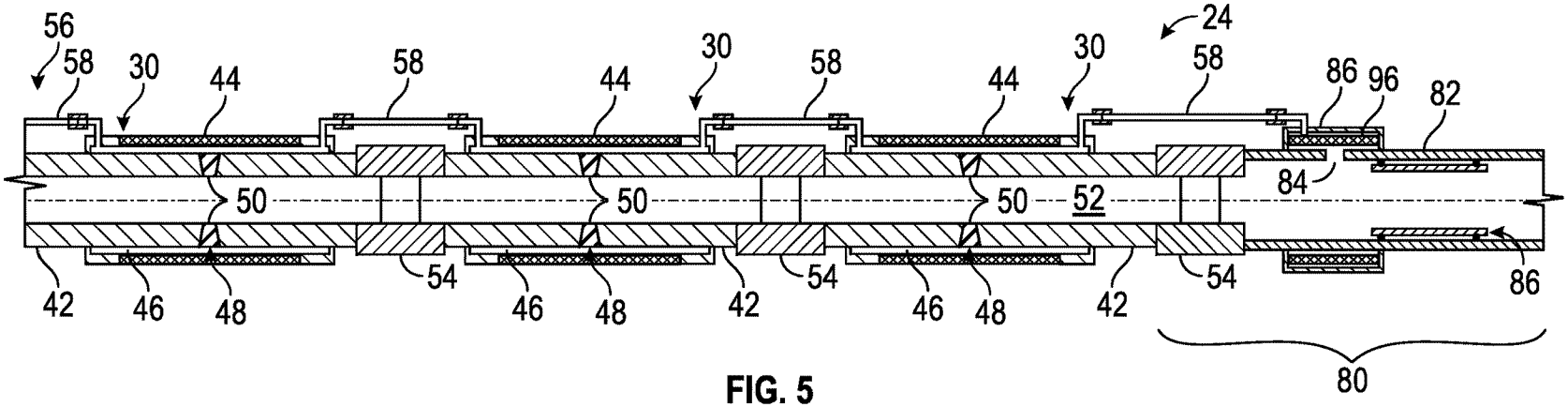
FIG. 5 is a schematic illustration of an example of a gravel packing completion comprising a plurality of screen assemblies combined with drainage layer shunt tubes which deliver returning carrier fluid to a sliding sleeve assembly, according to an embodiment of the disclosure.
Figure 6:
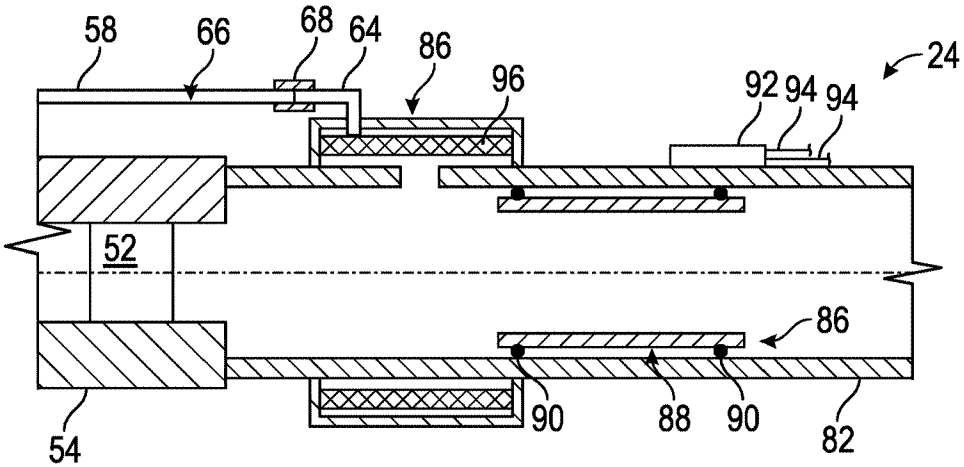
FIG. 6 is a cross-sectional illustration of an example of the sliding sleeve assembly illustrated in FIG. 5, according to an embodiment of the disclosure.

Referring generally to FIGS. 5 and 6, another embodiment of gravel packing completion 24 is illustrated. In this embodiment, sequential screen assembly sections 30 have drainage layers 46 connected by drainage layer shunt tubes 58 of drainage layer shunt tube system 56 as described above. However, at least one of the drainage layers 46 is placed in communication with a sliding sleeve assembly 80 via at least one drainage layer shunt tube 58. In this embodiment, the gravel packing completion 24 comprises the sliding sleeve assembly 80 which may be coupled to an adjacent screen assembly section 30 via one of the couplings 54. For example, the coupling 54 may be used to couple base pipe 42 of the adjacent screen assembly section 30 with a corresponding housing 82 of the sliding sleeve assembly 80.

As illustrated in FIG. 6, housing 82 comprises an opening 84 which may be in the form of a port or ports placed in fluid communication with the corresponding drainage layer shunt tube 58. In the example illustrated, the end of the drainage layer shunt tube 58 proximate sliding sleeve assembly 80 is coupled with an outer housing 86 sealably engaged with housing 82 and surrounding opening, e.g. port(s), 84. This arrangement provides a fluid communication passageway from the sequential drainage layers 46 to the opening 84 so as to route returning carrier fluid from the drainage layers 46 into an interior of housing 82 which is part of the overall interior 52. The returning carrier fluid may then be routed to the surface or to another desired collection location.

The sliding sleeve assembly 80 further comprises a closure system 86 which may be selectively actuated to open or close opening 84 with respect to fluid flow through opening 84. By way of example, closure system 86 may comprise a sliding sleeve 88 slidably mounted within housing 82. As illustrated, the sliding sleeve 88 may be sealed with respect to an interior surface of housing 82 via a plurality of seals 90. The closure system 86, e.g. sliding sleeve 88, is selectively shiftable to an open port position, as illustrated, which allows carrier fluid resulting from dehydrating of the gravel slurry to flow into the interior 52 of the gravel packing completion 24.

Upon completion of the gravel packing operation, the closure system 86, e.g. sliding sleeve 88, may be shifted past opening 84 to a closed port position which blocks further flow through opening 84. The opening 84 may be closed off during, for example, production operations in which well fluid flows into interior 52 via inflow control devices 48 for production to a surface collection location.

The closure system 86 may be actuated via a variety of mechanisms. If sliding sleeve 88 is utilized, for example, a shifting tool may be run downhole through the interior of gravel packing completion 24 to engage and shift the sliding sleeve 88 between the open port and closed port positions. The shifting tool may be run on a work string, wireline, coiled tubing, drill pipe, or other suitable conveyance. In some applications, however, a downhole actuator 92 may be coupled with sliding sleeve 88 to shift the sliding sleeve between the open port and closed port positions. By way of example, the downhole actuator 92 may be an electromechanical actuator or a hydraulic actuator coupled to a surface control by, for example, communication lines 94. However, downhole actuator 92 also may be constructed to enable wireless control.

In some applications, returning carrier fluid is filtered prior to entry into interior 52 through opening 84. By way of example, a filter 96 may be located upstream of opening 84 to filter the inflowing carrier fluid. In the specific example illustrated, the filter 96 is located within outer housing 86 and externally of housing 82 proximate opening/ports 84.

Depending on the operation, the sliding sleeve assembly 80 may be coupled into gravel packing completion 24 at a variety of selected locations. For example, the sliding sleeve assembly may be connected to accept flow of returning carrier fluid from a downhole location or from both downhole and uphole locations. The sliding sleeve assembly 80 also may be utilized with alternate path systems comprising, for example, slurry shunt tubes 72 and packing tubes 74.

Many types of materials, components, and component configurations may be used in constructing the gravel packing system described herein. For example, the filter screens may be made from a variety of woven and nonwoven materials in various patterns and arrangements. Similarly, the drainage layer shunt tubes may be made in various shapes, sizes and configurations. Additionally, the drainage layer shunt tubes may be made from solid walled tubes or from tubes having porous sections comprising meshes, screens, porous materials, and/or other suitable materials. The gravel packing system also may comprise different numbers of drainage layer shunt tubes, base pipes, filter screens, couplings, slurry shunt tubes, packing tubes, and/or other components and features to facilitate gravel packing of a desired well zone or zones.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a gravel packing completion having a plurality of screen assembly sections, each screen assembly section comprising:

a base pipe;

an inflow control device disposed along the base pipe; and a filter screen disposed about an exterior of the base pipe and forming a drainage layer between the filter screen and the base pipe, wherein adjacent screen assembly sections are joined by a coupling connected between adjacent base pipes, the adjacent screen assembly sections further being joined by a drainage layer shunt tube disposed externally of the coupling and fluidly connecting drainage layers of the adjacent screen assembly sections, wherein the drainage layer shunt tube comprises a straight shunt tube section coupled with a pair of shunt tube elbows via a pair of shunt tube connectors.

2. The system as recited in claim 1, wherein the gravel packing completion comprises a sliding sleeve assembly coupled to at least one of the drainage layers, the sliding sleeve assembly comprising a port which may be selectively opened to allow return flow of a carrier fluid from at least one of the drainage layers to an interior of the gravel packing completion.

3. The system as recited in claim 2, wherein the sliding sleeve assembly comprises a shiftable sleeve slidably mounted within an assembly housing.

4. The system as recited in claim 2, wherein the sliding sleeve assembly comprises a filter disposed to filter the carrier fluid before the carrier fluid passes through the port.

5. The system as recited in claim 1, wherein the base pipe is solid walled and combined with an inflow control device to enable flow of fluid from an exterior to an interior of the base pipe.

6. The system as recited in claim 1, wherein the filter screen of each screen assembly section is mounted to the base pipe by a plurality of end rings.

7. The system as recited in claim 6, wherein the drainage layer shunt tube is communicatively coupled with drainage layers of adjacent screen assembly sections via end rings of the adjacent screen assembly sections.

8. The system as recited in claim 1, wherein the gravel packing completion further comprises a plurality of slurry shunt tubes and packing tubes for delivering a slurry to a desired well zone.

9. A method to facilitate a gravel packing operation, comprising:

delivering a gravel slurry downhole into a wellbore to gravel pack a wellbore zone between a wellbore wall and a gravel packing completion;

dehydrating the gravel slurry by providing a carrier fluid flow path into drainage layers of a plurality of screen assembly sections connected by couplings to form at least a portion of the gravel packing completion;

enhancing the dehydration rate by coupling drainage layers of at least some adjacent screen assembly sections of the plurality of screen assembly sections via drainage layer shunt tubes; and routing a carrier fluid along the carrier fluid flow path, through the drainage layers and the drainage layer shunt tubes, and into an interior of the gravel packing completion via a sliding sleeve assembly.

10. The method as recited in claim 9, further comprising routing at least one of the drainage layer shunt tubes around an exterior of a corresponding coupling connecting adjacent screen assembly sections.

11. The method as recited in claim 9, further comprising utilizing couplings to connect adjacent base pipes of adjacent screen assembly sections.

12. The method as recited in claim 11, further comprising providing each base pipe with an inflow control device.

13. The method as recited in claim 9, further comprising selectively positioning the sliding sleeve assembly in an open port position allowing carrier fluid resulting from dehydrating the gravel slurry to flow into the interior of the gravel packing completion.

14. The method as recited in claim 13, further comprising selectively positioning the sliding sleeve assembly in a closed port position during a production phase after completing the gravel pack.

15. The method as recited in claim 9, wherein delivering comprises delivering at least a portion of the gravel slurry through slurry shunt tubes and packing tubes.

16. A system, comprising:

a first screen assembly section having a first base pipe section within a first filter screen to form a first drainage layer between the first base pipe section and the first filter screen;

a second screen assembly section having a second base pipe section within a second filter screen to form a second drainage layer between the second base pipe section and the second filter screen;

a coupling connecting the first base pipe section to the second base pipe section; and a drainage layer shunt tube connecting the first drainage layer with the second drainage layer, wherein the drainage layer shunt tube comprises a straight shunt tube section coupled with a pair of shunt tube elbows via a pair of shunt tube connectors.

17. The system as recited in claim 16, wherein the first base pipe section and the second base pipe section are each solid walled and combined with an inflow control device to provide a flow path between a base pipe exterior and a base pipe interior.

18. The system as recited in claim 16, further comprising a sliding sleeve assembly communicatively coupled with at least one of the first drainage layer and the second drainage layer via a shunt tube.

* * * * *